US005153939A

United States Patent [19]

Howe et al.

[11] Patent Number: 5,153,939

[45] Date of Patent: Oct. 13, 1992

[54] KNIT FABRIC MATERIAL WITH STRETCH AND INSULATIVE PROPERTIES AND RELATED ARTICLES OF CLOTHING

[76] Inventors: Philip M. Howe, 182 Marlborough St., Boston, Mass. 02116; Eleanor J. Howe, 159 Crosby Street, Arlington, Mass. 02174

[21] Appl. No.: 479,851

[22] Filed: Feb. 14, 1990

[51] Int. Cl.[5] ..... A41D 1/00

[52] U.S. Cl. ..... 2/69; 2/164; 2/201; 2/272

[58] Field of Search ..... 2/172, 98, 108, 123, 2/69, 162, DIG. 11, 170, 97, 164, 184.5, 194, 201, 207, 272; 428/284, 224, 225, 230, 231

[56] References Cited

U.S. PATENT DOCUMENTS

| | | | |
|---|---|---|---|
| 1,491,615 | 4/1924 | Newlen | 2/172 |
| 2,268,210 | 12/1941 | Fried | 2/162 |
| 3,337,877 | 8/1967 | Lipkin | 2/172 |
| 3,358,292 | 12/1967 | Bonk et al. | 2/172 |
| 3,414,906 | 12/1968 | Bonk et al. | 2/172 |
| 3,497,415 | 2/1970 | Adachi | 161/76 |
| 4,034,417 | 7/1977 | Ellis | 2/81 |
| 4,095,292 | 6/1978 | Klein | 2/161 A |
| 4,114,200 | 9/1978 | Smith et al. | 2/123 X |
| 4,195,362 | 4/1980 | Rolando | 2/108 X |
| 4,302,496 | 11/1981 | Donovan | 428/196 |
| 4,523,337 | 6/1985 | Leibowitz | 2/237 |
| 4,555,428 | 11/1985 | Cole | 428/102 |
| 4,608,721 | 9/1986 | Lipkin | 2/172 |
| 4,630,317 | 12/1986 | Brown et al. | 2/12 |
| 4,656,671 | 4/1987 | Manges | 2/DIG. 11 X |
| 4,705,717 | 11/1987 | Cain et al. | 428/252 |
| 4,752,972 | 6/1988 | Neckerman et al. | 2/123 |
| 4,776,044 | 10/1988 | Makins | 2/172 X |

OTHER PUBLICATIONS

Potter, M. David, and Corbman, Bernard P., *Textile: Fiber to Fabric, 4th Edition (McGraw-Hill Book Company, 1967), pp. 12-13, 56 and 399-410.*

*Primary Examiner*—Werner H. Schroeder
*Assistant Examiner*—Sara M. Current
*Attorney, Agent, or Firm*—Fish & Richardson

[57] ABSTRACT

An article of clothing is disclosed which is made from two outer layers of a knit fabric material and an intermediate layer of flexible windbreak material between the two knit layers. The windbreak material is a woven material which effectively blocks the flow of air and at least some of the threads from which it is woven are threads having an elastic core and staple fibers covering the core, such as spandex. Various articles of apparel may be manufactured from the fabric material, including gloves, hats, socks, suits, and scarves. Also disclosed is a headband that has fasteners for removably attaching to a hat and a narrow portion at the forehead and a wider portion at the ears and back of neck so as to cover the adjacent portions of a wearer's body.

20 Claims, 3 Drawing Sheets

KNIT FABRIC MATERIAL WITH STRETCH AND INSULATIVE PROPERTIES AND RELATED ARTICLES OF CLOTHING

BACKGROUND OF THE INVENTION

The invention relates to knit fabrics and articles of clothing made from them.

Knit fabrics are made by intertwining yarn or thread in a series of connected loops. Knit fabrics have been made of wool, cotton, acrylic, other manmade fabrics and varying combinations of these materials. Knit fabrics are soft and flexible, have the ability to retain warmth, have a comfortable texture and feel and a desirable aesthetic appearance. Knit fabrics can be created in virtually every color, shade and mixture and cover a broad range of prices. Knit fabrics, however, are porous and offer little protection against wind, which penetrates the knit fabric to the wearer, even when tightly knit.

SUMMARY OF THE INVENTION

In one aspect, our invention features in general a knit fabric material having two outer layers of knit fabric and an intermediate layer of windbreak flexible material between the knit fabric layers. The outer knit layers provide the warmth, feel and appearance of knits, and the intermediate layer provides windbreak properties. Because the intermediate material is flexible, it flexes with the knit fabrics. Because it is hidden from view, the material, and articles made from it, appear to be traditional knits.

In preferred embodiments, the intermediate layer is a woven material that is stitched to one or both outer layers by criss-crossing stitches across the areas of the layers; the outer knit fabrics are made of wool, acrylic, cotton or blends of these fibers and the intermediate material is made of spandex, e.g., available under the Lycra trade designation from DuPont.

The material can very desirably be employed in knit hats, jackets, sweaters, gloves, scarves and many other articles of clothing.

In another aspect, the invention features, in general, providing a hat with a removable headband that has a fastening device to removably attach it to the hat and a narrow portion at the forehead and a wider portion at the ears and back of neck so as to cover the most exposed areas.

In preferred embodiments, the headband is made of multiple layers of material, the outer layers being of knit fabric and an intermediate layer being a windbreak flexible material; the windbreak layer extends beyond the knit fabrics at an extended portion, and the fasteners are attached to the extended portion, thereby providing a minimum thickness inside the hat where the headband is attached.

Other features and advantages of the invention will be apparent from the following description of a preferred embodiment thereof and from the claims.

DESCRIPTION OF THE PREFERRED EMBODIMENT

Drawings

STRUCTURE

Figure 1:
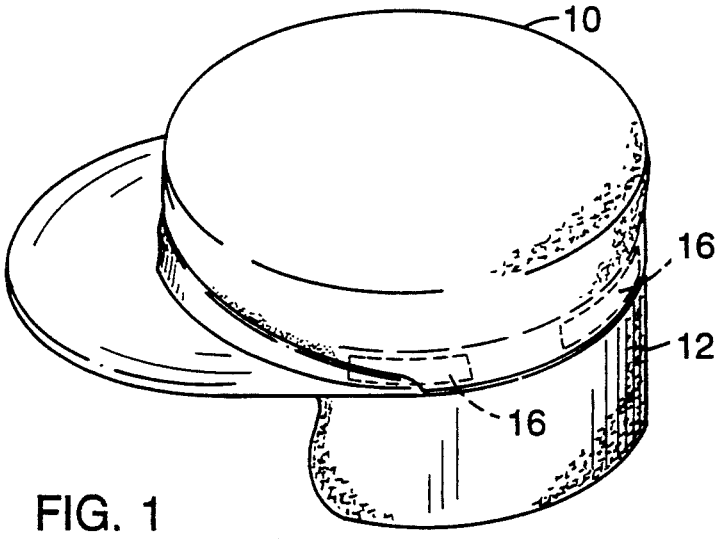
FIG. 1 is a perspective view of a hat and a removable headband made according to the invention.
Figure 2:
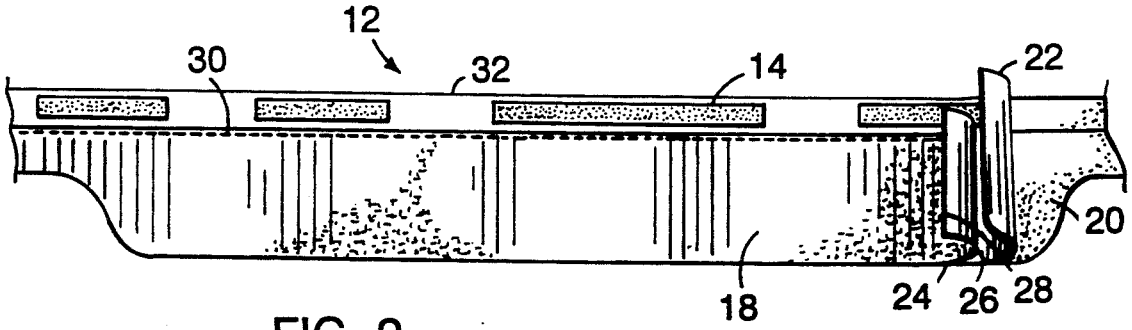
FIG. 2 is a plan view, with layers shown partially separated, of the FIG. 1 removable headband.
Figure 3:
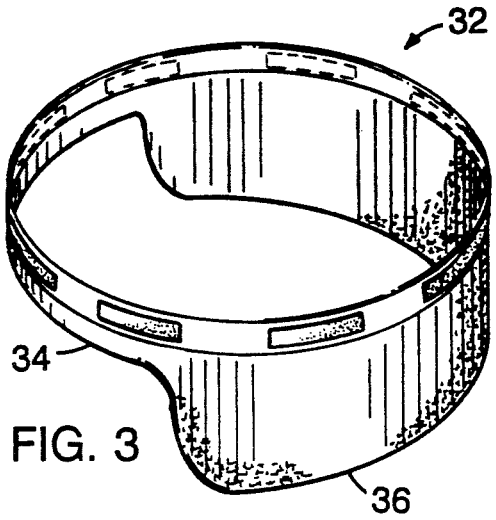
FIG. 3 is a perspective view of an alternative, most-preferred, headband structure.

The improved knit fabric with stretch and insulative properties can be employed in many articles of clothing, such as hats, jackets, sweaters, etc., and is shown used in the headband of FIGS. 1–3 only by way of example.

Referring to FIGS. 1, 2 and 3, hat 10 has removable headband 12 attached via VELCRO hook fastener strips 14 adhesively secured near the upper edge of headband 12 and mating VELCRO loop fastener strips 16 adhesively secured near the lower edge of the inside of hat 10.

Headband 12 is attached to the hat by pressing the VELCRO patches on the headband against the VELCRO patches inside the hat. The headband, when not in use, can either be removed from the hat or folded up into the hat. The advantages of headband 12 are many. It turns any hat, man's or woman's, into a warm winter hat. It is interchangeable by using more than one headband with a particular hat or by using different headbands interchangeably with different hats. Lastly, when not in use, the headband is easily removed.

Referring to FIG. 3, alternative headband 32 forms a continuous loop having a small-width forehead portion 34 and a large-width ear and back portion 36 in order to effectively cover the exposed areas of the wearer.

Referring to FIG. 2, headband 12 is made of outer knit layers 18, 20 and intermediate layer 22 of windbreak flexible material. Layers 18, 20 and 22 are stitched to each other along their bottom edges at folded over portions 24, 26 and 28, respectively, via stitches that are hidden in completed headband 12. Outer knit layers 18, 20 are folded over at the top edges and attached to each other and intermediate layer 22 via stitches 30. Intermediate layer 22 extends upward beyond stitches 30 and carries fastener strips 14 on extended portion 32. Because only the relatively thin intermediate layer (and not the outer layers) overlies the hat in use, the extra thickness inside the hat is desirably kept to a small amount.

Knit layers 18, 20 can be made of virtually any size or type of yarn such as wool, acrylic, cotton or blends thereof. Intermediate layer 22 may be made of any of a variety of flexible windbreak materials. The presently most preferred materials are spandex materials (e.g., materials available under the LYCRA trade designation from DuPont). Spandex yarns have the property of stretching five to seven times the lengths of their relaxed states without breaking. The yarns have a spandex core (which could be as little as 5 to 15 percent of the entire yarn) with a layer of any staple fiber spun around the core as it is held under a predetermined amount of tension. When the fiber is relaxed after spinning, the spandex core returns to its normal length, which pulls the outer layer of spun fibers into a more compact formatter. Since the core is enclosed in the layer of staple fibers, the yarn takes on the feel and appearance of the staple fibers. Such yarns are described in Potter, M. David, and Corbman, Bernard P., *Textile: Fiber to Fabric*, 4th Edition (McGraw-Hill Book Company 1967), particularly pages 12–13, 56 and 399–410, which is hereby incorporated by reference. Spandex is also available from other sources, e.g., under the BLUE C designation from the Chemstrand Division of Monsanto, under the GLOSPAN trade designation from Globe Manufacturing Company of Fall River, Mass., under the NUMA trade designation from the American Cyanamid Company, and under the VYRENE and LASTEX trade designations from U.S. Rubber Company. Spandex materials are commercially available in different thicknesses; depending upon the particular use of the material, an appropriate spandex can be employed to provide more or less flexibility and the required resistance to wind penetration. Other materials that can be employed are nylon materials that have been provided with bands of elastic material between bands of nylon (which is relatively inflexible). These flexible windbreak materials are woven materials having sufficiently dense threads and a sufficiently high number of threads per unit area to effectively block the flow of air through them to an extent that air flow is not significantly perceived by the wearer. The materials also are sufficiently flexible so as to not inhibit flexing of the knit layers and to flex with them. In addition, the materials are thin, lightweight and washable. Nonwoven sheet materials could also be used for layer 22 so long as the materials effectively block flow of air and have sufficient flexibility, both as just described.

The resulting composite material of layer 22 looks like a knit fabric, flexes like a knit fabric, has the luxuriant softness of a knit fabric, has the warmth of a knit fabric and, in addition, breaks the wind in a manner in which knit fabrics do not. Thus, the quality of wind resistance is provided to a knit fabric without any alteration or loss of desirable features of the knit fabric in the resulting knit fabric material. Moreover, the windbreak flexible material provides a great amount of insulation while adding little cost to the cost of material; e.g., when used with acrylic knits, it makes the material much warmer than the much more expensive wool material usually employed to provide high levels of warmth. The use of stitching to secure the layers of the knit fabric material together has associated with it a minimum area of adhesion of one fabric to another, keeping cost low and permitting the layers to form insulation, and keeping manufacture simple. This enhances the soft look as well as the quality of retaining body heat in the layers of air between the layers of fabric. Articles of clothing made from the knit fabric material according to the invention have better insulation than traditional knits, and can, e.g., limit the caking of snow on knit hats owing to initial melting and subsequent freezing. The use of flexible material for the windbreak layer avoids tearing that would occur if a nonflexible layer were secured to a flexible outer layer.

Figure 4:
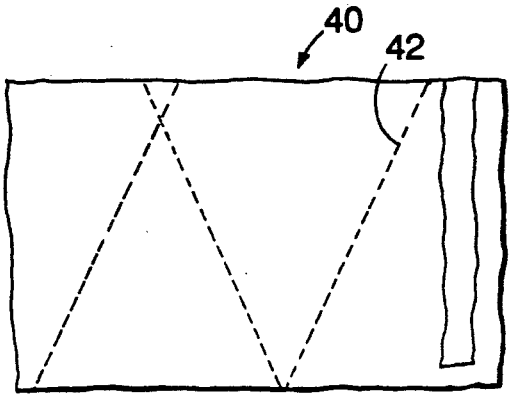
FIG. 4 is a plan view of a material according to the invention having additional stitching.

When incorporated in clothing, the top and bottom layers of knit are joined when the fabric is sewn into a garment by the seams of the garment. There can be additional stitching across surface areas of the material. E.g., referring to FIG. 4, knit fabric material 40 has criss-cross stitching across all three layers of the material instead of just edge stitching. This would desirably be employed in clothing having large fabric surface areas such as sweaters or jackets or fabric blankets made of the material.

OTHER EMBODIMENTS

Figure 5:
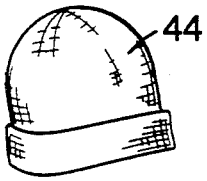
FIGS. 5–14 are plan views of a knit hat, glove, mitten, jacket, sweater, scarf, sock, dress, suit and skirt, respectively, made according to the invention.
Figure 6:
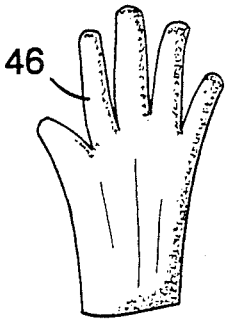
Figure 7:
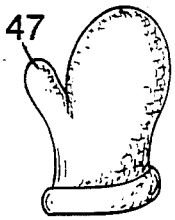
Figure 8:
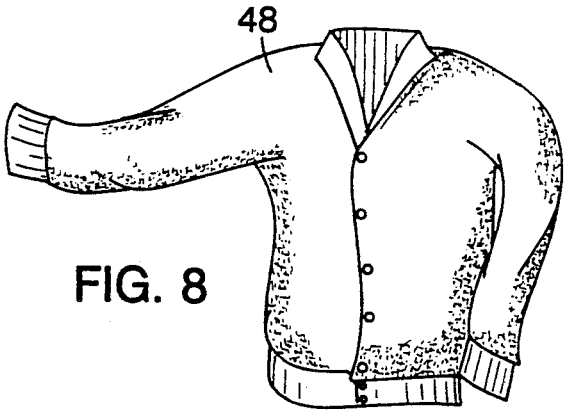
Figure 9:
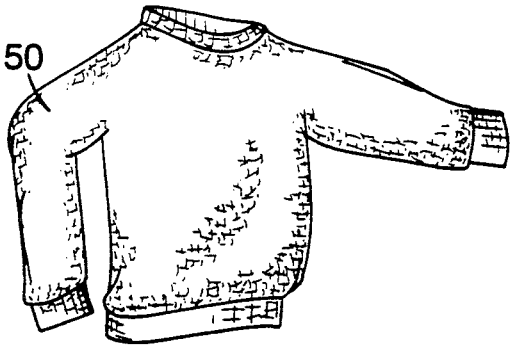
Figure 10:
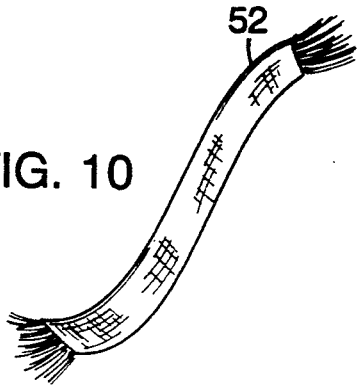
Figure 11:
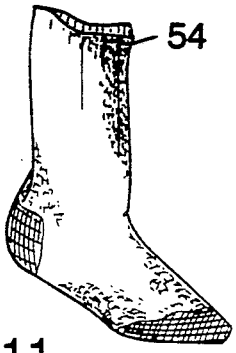
Figure 12:
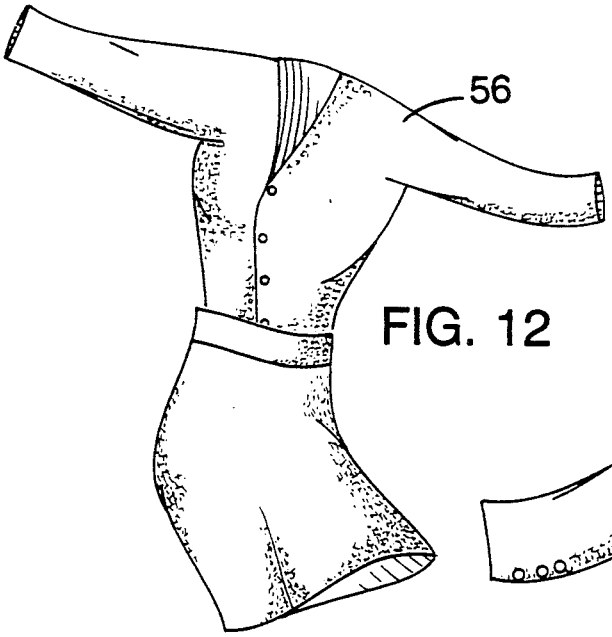
Figure 13:
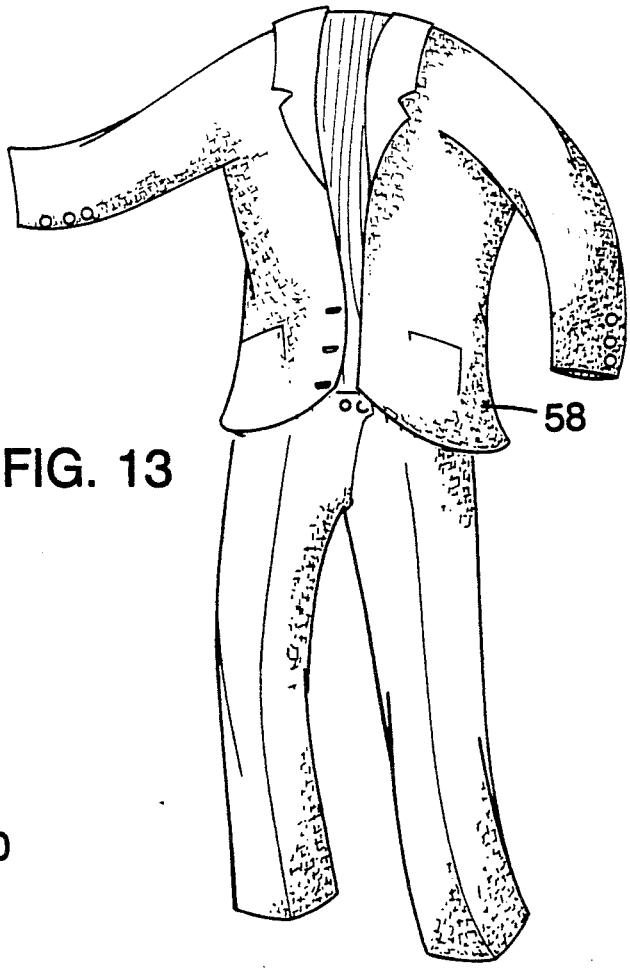
Figure 14:
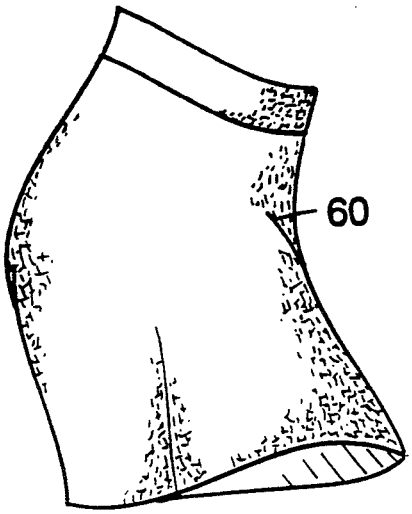

Other embodiments are within the scope of the following claims. The knit fabric material of the invention could be used in virtually any clothing where the knit fabric look, warmth and feel if desired along with windbreak, properties, e.g , knit hat 44 (FIG. 5) glove 46 (FIG. 6) mitten 47 (FIG. 7) jacket 48 (FIG. 8) sweater 50 (FIG. 9) jacket collars and cuffs, scarf 52 (FIG. 10) children's clothes sock 54 (FIG. 11) blankets, dress 56 (FIG. 12) and women's suit 58 (FIG. 13) and skirt 60 (FIG. 14).

In some applications, it might be desirable to stitch the intermediate layer to one knit fabric layer but not the other knit fabric layer. The two outer layers of knit fabric could be of different material; e.g., the exposed outer layer could have ribbing and be made of larger-size thread or yarn to provide a desired appearance, and the outer layer that is against the wearer in use might be smoother and made of smaller-sized thread or yarn for ease in putting on the clothing.

What is claimed is:

1. An article of clothing comprising body covering portions covering substantial heat releasing surfaces of a wearer's body, said body covering portions being made of knit fabric material that covers said heat releasing surfaces, said material comprising two outer layers of knit fabric, and an intermediate layer of windbreak flexible material between said layers of knit fabric, said intermediate layer covering substantially the whole area of the two outer layers, said windbreak material being a woven material having sufficiently dense threads and a sufficiently high number of threads per unit area to effectively block the flow of air through said body covering portions to said substantial heat releasing surfaces of a wearer's body to an extent that it is not significantly perceived by the wearer, at least some of said threads having an elastic core and staple fibers around the core.

2. The article of claim 1 wherein said intermediate layer is a woven material that is stitched to said two outer layers.

3. The article of claim 1 wherein said article is a headband having fasteners near an upper edge thereof adapted to engage fasteners on a hat.

4. The article of claim 3 wherein said fasteners are hook and loop type fasteners.

5. The article of claim 3 wherein said intermediate layer is a woven material that is stitched to said two outer layers.

6. The article of claim 1 wherein intermediate layer is stitched to both said outer layers by stitches across surface areas of the layers.

7. The article of claim 1 wherein said intermediate layer is made of spandex.

8. The article of claim 1 wherein said article is a sweater or jacket.

9. The article of claim 1 wherein said article is a knit hat made entirely of said knit fabric material.

10. The article of claim 9 wherein said intermediate layer is made of spandex.

11. The article of claim 1 wherein said article is a glove or mitten.

12. The article of claim 1 wherein said article is a scarf.

13. The article of claim 1 wherein the entire article if made of said knit fabric material.

14. The article of claim 1 wherein said article is a sock.

15. The article of claim 1 wherein said article is a dress.

16. The article of claim 1 wherein said article is a skirt.

17. The article of claim 1 wherein said article is a suit.

18. A headband for removably attaching to a hat worn by a person having ears and a neck with a back that are the most exposed areas, said headband comprising a continuous band of fabric material having a narrow portion at the forehead and a wider portion at the ears and back of the neck so as to cover the most exposed areas, and removable fasteners near an upper edge of said headband adapted to engage fasteners on a hat, wherein said fabric material is made of multiple layers of material, one of said layers being an intermediate layer of flexible windbreak material and two other of said layers being outer layers of knit fabric material, said intermediate layer covering substantially the whole area of the two outer layers, said windbreak material being a woven material having sufficiently dense threads and a sufficiently high number of threads per unit area to effectively block the flow of air to an extent that it is not significantly perceived by the wearer, at least some of said threads having an elastic core and staple fibers around the core.

19. The headband of claim 18 wherein said windbreak layer extends beyond said knit layer at an extended portion, and said fasteners are attached to said extended portion.

20. The headband of claim 18 wherein said flexible windbreak layer is made of spandex.

* * * * *